US006025581A

United States Patent [19]

Kang et al.

[11] Patent Number: 6,025,581

[45] Date of Patent: Feb. 15, 2000

[54] APPARATUS FOR ASSEMBLING DOOR AND MAIN BODY IN MICROWAVE OVEN

[75] Inventors: Jong Soo Kang; Kwan Ho Lee, both of Kyungsangnam-do, Rep. of Korea

[73] Assignee: LG Electronics Inc., Seoul, Rep. of Korea

[21] Appl. No.: 09/190,274

[22] Filed: Nov. 13, 1998

[30] Foreign Application Priority Data

Nov. 15, 1997 [KR] Rep. of Korea ..... 97/60240

[51] Int. Cl.[7] ..... H05B 6/76

[52] U.S. Cl. ..... 219/739; 219/722; 219/756; 126/194; 16/225; 16/232

[58] Field of Search ..... 219/739, 740, 219/741, 742, 756, 757, 722, 724; 16/225, 223, 232; 126/194, 197

[56] References Cited

U.S. PATENT DOCUMENTS 3,679,855 7/1972 Binzer ..... 219/739
3,979,573 9/1976 Burns et al. ..... 219/739
5,726,427 3/1998 Hwang ..... 219/739

FOREIGN PATENT DOCUMENTS 3-11-232 1/1991 Japan ..... 219/739
4-12492 1/1992 Japan ..... 219/739

*Primary Examiner*—Philip H. Leung
*Attorney, Agent, or Firm*—Fleshner & Kim

[57] ABSTRACT

An apparatus for assembling a door and a main body in a microwave oven is disclosed, in which a door can easily be mounted in a main body of a microwave oven. The apparatus for assembling a door and a main body in a microwave oven includes a hinge plate mounted in a main body of a microwave oven, a hinge shaft mounted in a cut-open portion of a choke cover fixed to a door, for being rotatably fixed to the hinge plate, and a detachment prevention portion elastically deformed to allow the hinge plate to be fixed to the hinge shaft and restored to the original state if the hinge plate is completed to be fixed to the hinge shaft to prevent the hinge plate from being detached from the hinge shaft. The detachment prevention portion includes a supporting portion for supporting the hinge plate when the hinge plate is fixed to the hinge shaft, and a vertical portion connected to one end of the supporting portion.

20 Claims, 3 Drawing Sheets

APPARATUS FOR ASSEMBLING DOOR AND MAIN BODY IN MICROWAVE OVEN

BACKGROUND OF THE INVENTION

1. Field of the Invention

The present invention relates to a microwave oven, and more particularly, to an apparatus for assembling a door and a main body in a microwave oven, in which a door can easily be mounted in a main body of a microwave oven.

2. Discussion of the Background Art

Generally, a door which cuts off a cavity from the outside is mounted at the front of a main body in a microwave oven to be close and open. At the door, a choke structure is mounted to allow electromagnetic wave of the microwave oven not to be externally transferred. A choke cover which covers the choke structure is mounted in the choke structure.

Meanwhile, to facilitate assembly of the main body and the door and to prevent the product of poor quality from being produced in the assembly process, a door is manufactured as one assembly body and then the door is assembled with a main body in assembly line of the microwave oven finished product.

A background art apparatus for assembling a door and a main body in a microwave oven will be described with reference to FIGS. 1 and 2.

A hinge plate 22 having a hole is mounted in lower and upper portions at one side of a main body 20 in a microwave oven. A hinge shaft which is hinge-coupled with the hinge plate 22 is mounted in a door 10.

Describing the background art apparatus for assembling a door and a main body in a microwave oven in detail, a choke cover 12 is mounted in a choke structure formed at an inner side of the door 10. An edge portion at one side of the choke cover 12 is cut open, so that the hinge shaft is mounted. In other words, the hinge shaft of the door 10 is rotatably fixed to the hinge plate 22 of the main body 20.

After the hinge shaft is fixed to the hinge plate 22, a detachment prevention cap 14 is assembled in the cut-open portion of the choke cover 12 to prevent the door 10 from being detached from the main body.

However, the aforementioned apparatus for assembling a door and a main body in a microwave oven has several problems.

First, since the detachment prevention cap 14 should separately be manufactured and assembled, the manufacturing cost of the microwave oven increases.

Second, if any impact is externally applied to the door 10 in the course of using the microwave oven, the detachment prevention cap 14 may be detached from the choke cover 12 and lost. Also, the door 10 may be detached from the main body 20 as the detachment prevention cap 14 is detached from the choke cover 12.

To solve such problems, it has been suggested, as shown in FIG. 2, that the detachment prevention cap is assembled with the choke cover in an integral form.

In other words, the detachment prevention cap 14 is formed in the choke cover 12 in an integral form, and the door 10 is assembled in the main body 20 at the state that the detachment prevention cap 14 is open. After the door 10 is assembled in the main body 20, the detachment prevention cap 14 is closed. In this structure, the detachment prevention cap 14 may be detached from the choke cover 12 but is not lost because the detachment prevention cap 14 is formed in the choke cover in an integral form.

However, the apparatus for assembling a door and a main body in a microwave oven shown in FIG. 2 has several problems.

First, since the door 10 should be assembled at the state that the detachment prevention cap 14 is open, the detachment prevention cap 14 disturbs the assembly process, thereby causing inconvenience of the assembly process.

Second, at the state that the detachment prevention cap 14 which is integral with the choke cover 12 is inserted into or detached from the door 10, if the detachment prevention cap 14 is frequently detached in the course of circulating step of the product or during movement for assembly of the product, white stripe occurs in a connecting portion 13 between the choke cover 12 and the detachment prevention cap 14, thereby causing poor external appearance.

Finally, if any impact is externally applied to the door 10, the detachment prevention cap 14 is detached from the door 10 and thus the door 10 may be detached. In this structure, since the detachment prevention cap 14 is separately used, the manufacturing cost increases.

SUMMARY OF THE INVENTION

Accordingly, the present invention is directed to an apparatus for assembling a door and a main body in a microwave oven that substantially obviates one or more of the problems due to limitations and disadvantages of the background art.

An object of the present invention is to provide an apparatus for assembling a door and a main body in a microwave oven, in which a door can easily be mounted in a main body of a microwave oven.

Another object of the present invention is to provide an apparatus for assembling a door and a main body in a microwave oven, in which a door can stably be mounted in a main body of a microwave oven.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an apparatus for assembling a door and a main body in a microwave oven according to the present invention includes a hinge plate mounted in a main body of a microwave oven, a hinge shaft mounted in a cut-open portion of a choke cover fixed to a door, for being rotatably fixed to the hinge plate, and a detachment prevention portion elastically deformed to allow the hinge plate to be fixed to the hinge shaft and restored to the original state if the hinge plate is completed to be fixed to the hinge shaft to prevent the hinge plate from being detached from the hinge shaft.

The detachment prevention portion includes a supporting portion for supporting the hinge plate when the hinge plate is fixed to the hinge shaft, and a vertical portion connected to one end of the supporting portion, wherein the supporting portion is at least higher than an end of the hinge shaft, and a top of the vertical portion is tilt toward the hinge shaft. Also, it is preferable that a slit is formed in the supporting portion.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 5A and 5B are sectional views illustrating the process steps of assembling a door in a main body using an apparatus for assembling a door and a main body in a microwave oven according to the present invention, in which FIG. 5A shows a sectional view before the door is assembled in the main body and FIG. 5B shows a sectional view when the door is completed to be assembled in the main body.

DETAILED DESCRIPTION OF THE PREFERRED EMBODIMENTS

Reference will now be made in detail to the preferred embodiments of the present invention, examples of which are illustrated in the accompanying drawings.

Figure 1:
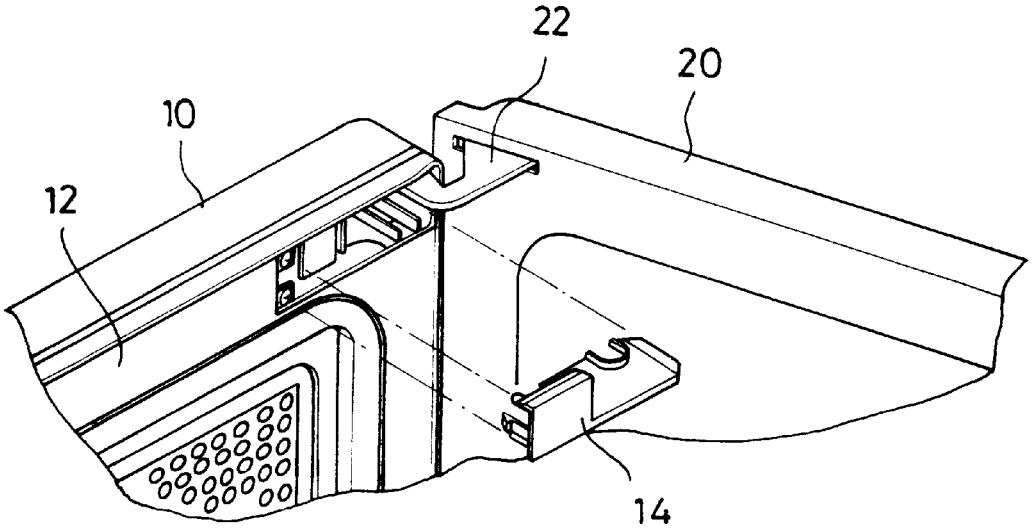
FIG. 1 Background Art
FIG. 1 is a perspective view illustrating a background art apparatus for assembling a door and a main body in a microwave oven.
Figure 2:
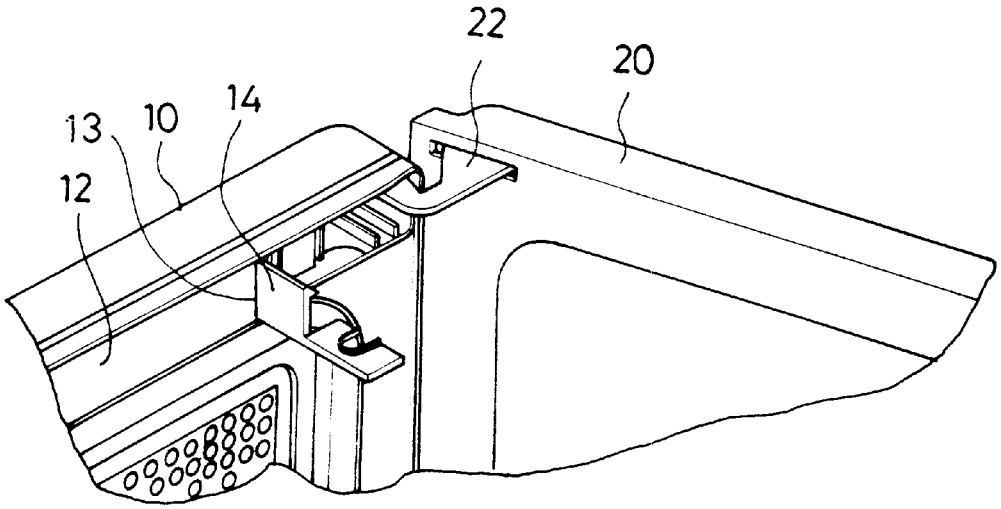
FIG. 2 Background Art
FIG. 2 is a perspective view illustrating another background art apparatus for assembling a door and a main body in a microwave oven.
Figure 3:
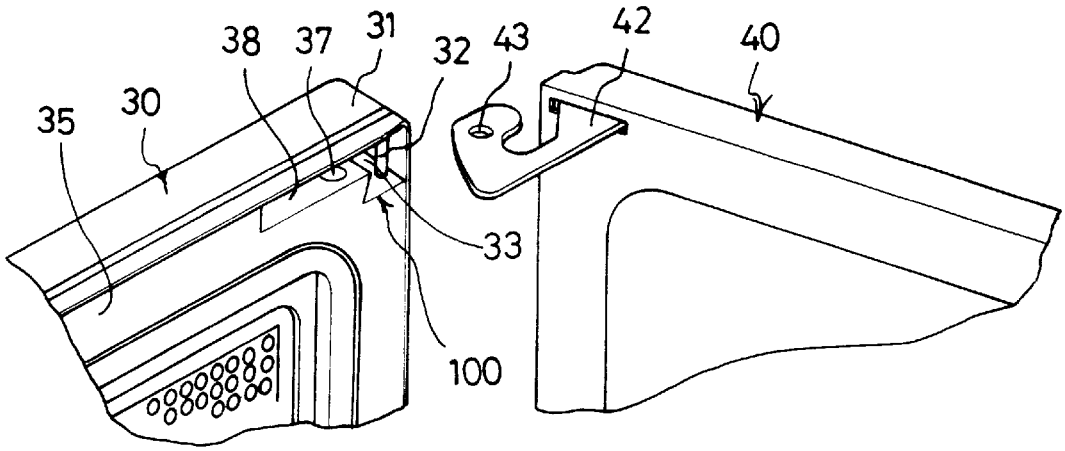
FIG. 3 is an exploded perspective view illustrating an apparatus for assembling a door and a main body in a microwave oven according to the present invention.
Figure 4:
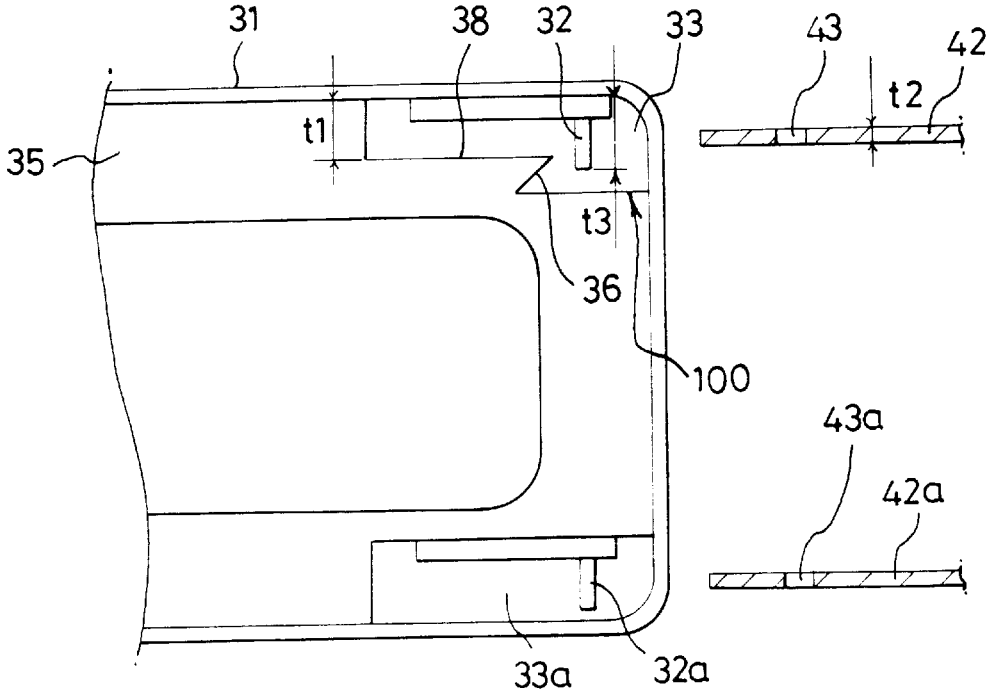
FIG. 4 is a rear view illustrating an apparatus for assembling a door and a main body in a microwave oven according to the present invention.

FIGS. 3 and 4 are an exploded perspective view and a rear view illustrating an apparatus for assembling a door and a main body in a microwave oven according to the present invention. The apparatus for assembling a door and a main body in a microwave oven according to the present invention will be described with reference to FIGS. 3 and 4.

The same elements as the background art have the same reference numerals as those of the background art and their description is omitted. Unlike the background art, it is intended in the present invention that a detachment prevention cap is not separately used.

As shown in FIG. 3, a hinge plate 42 mounted in a main body 40 of a microwave oven is rotatably fixed to a hinge shaft 32 mounted in a cut-open portion of a choke cover 35. The choke cover 35 is fixed to the door 30. If the hinge plate 42 is completed to be fixed to the hinge shaft 32, a detachment prevention portion 100 prevents the hinge plate 42 from being detached from the hinge shaft 32. The hinge shaft and the hinge plate are the same elements as those of the background art. However, the detachment prevention portion of the present invention is different from the detachment prevention cap of the background art.

Describing the apparatus for assembling a door and a main body in a microwave oven in detail, a choke cover 35 is mounted in a choke structure formed at an inner side of the door 30. An edge portion at one side of the choke cover 35 is cut open to ensure a space where the hinge shafts 32 is mounted, so that upper and lower cut-open portions 33 and 33*a* are formed.

The hinge shaft 32 is downwardly mounted in the cut-open portions 33 and 33*a*. The hinge shaft 32 may be mounted in a door frame 31 in an integral form with the door frame 31. Alternatively, the hinge shaft 32 may separately be manufactured and then mounted in the door frame 31.

Meanwhile, a detachment prevention portion 100 is formed in the upper cut-open portion 33 to prevent the door 30 from being detached from the main body 40 after the door 30 is mounted in the main body 40.

The detachment prevention portion 100 includes a horizontal supporting portion 38 separated from the door frame 31 at a predetermined distance and a vertical portion 36 formed at one end of the supporting portion 38.

It is noted that the distance t1 between the horizontal supporting portion 38 and the top of the choke cover 35 should be shorter than the distance t3 between the top of the choke cover 35 and the end of the hinge shaft 32. In other words, the supporting portion 38 should be placed higher than the end of the hinge shaft 32 so that the supporting portion 38 can prevent the hinge plate 42 from being detached from the hinge shaft 32 after the door 30 is mounted in the main body 40.

Further, it is preferable that the distance t1 between the supporting portion 38 and the top of the choke cover 35 is short so as to prevent a foreign substance from being externally entered into the choke structure by completely cutting off the choke structure. However, the the distance t1 should be at least greater than the thickness t2 of the hinge plate 42 and its length should be longer than the length of the hinge plate 42 because the hinge plate 42 should be inserted thereinto.

It is preferable that the vertical portion 36 is formed to be close to the hinge shaft 32 as far as possible so as to efficiently prevent the hinge plate 42 from being detached.

Furthermore, to facilitate the assembly, it is preferable that the vertical portion 36 is gradually narrow toward the top thereof. In other words, it is preferable that the vertical portion 36 is tilt toward the hinge shaft 32.

Moreover, the choke cover 35 is made of a material having elasticity. However, it is more preferable that a slit 37 is formed in the supporting portion 38 to more certainly give elasticity to the choke cover 35.

The process steps of assembling the door in the main body using the apparatus for assembling a door and a main body in a microwave oven hinge according to the present invention will be described with reference to FIGS. 4, 5A and 5B.

A hinge plate 42*a* at the bottom of the main body 40 is assembled with a hinge shaft 32*a* at the bottom of the door 30. Then, the hinge plate 42 at the top of the main body 40 is assembled with the hinge shaft 32 at the top of the door 30.

The process step of assembling the hinge plate 42 at the top of the main body 40 with the hinge shaft 32 at the top of the door 30 will be described in detail.

Figure 5A:
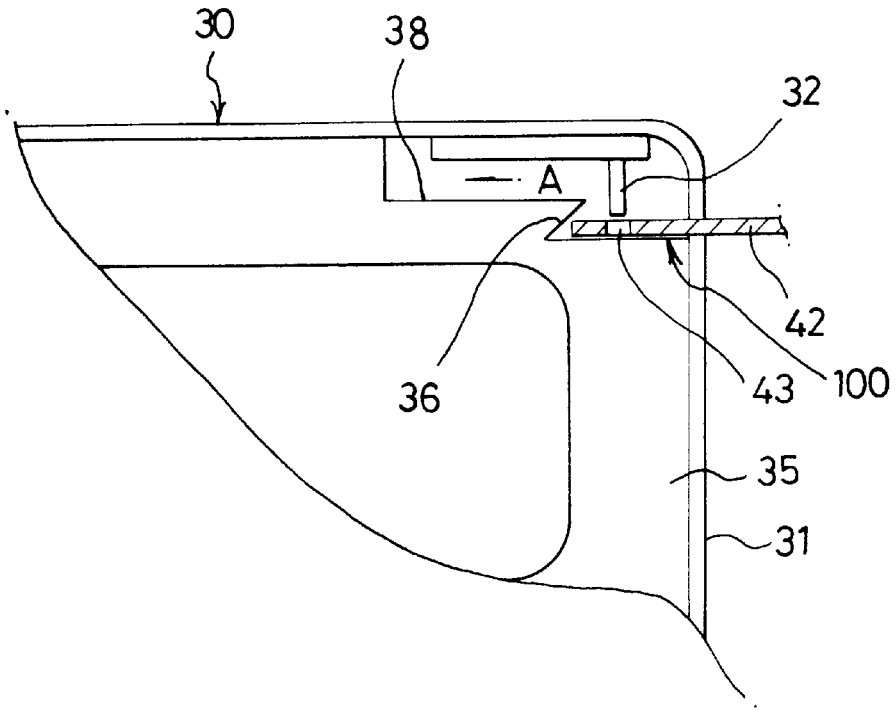
Figure 5B:
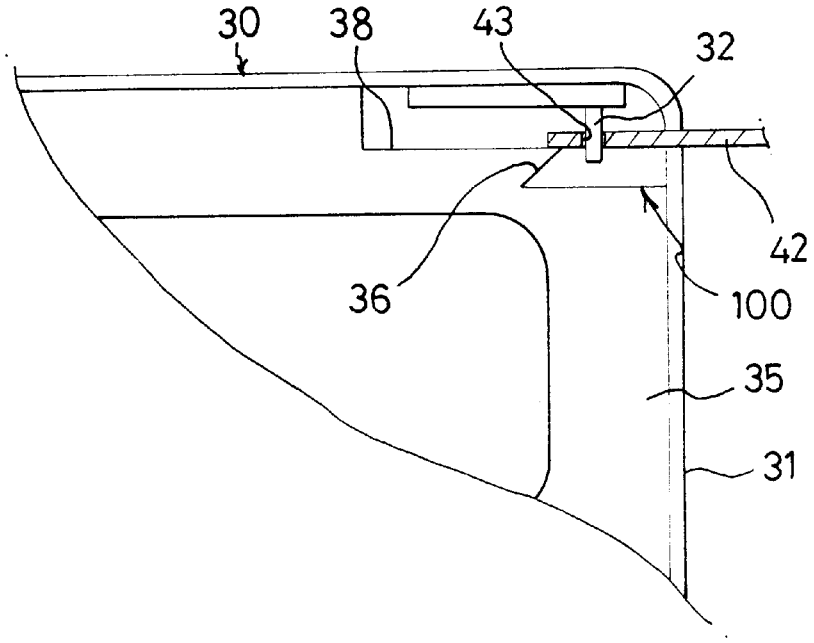

As shown in FIG. 5A, the hinge shaft 32 of the door 30 is placed over a hole 43 of the hinge plate 42 of the main body 40. In this state, if the door 30 is pushed downwardly, the end of the hinge plate 42 elastically transforms the vertical portion 36 of the detachment prevention portion 100 toward A and at the same time moves upwardly, so that the hinge shaft 32 is inserted into the hole 43 of the hinge plate 42. If the door 30 continues to be pushed, the end of the hinge plate 42 reaches the supporting portion 38. Then, as shown in FIG. 5B, the hinge plate 42 is mounted inside the supporting portion 38 and the vertical portion 36 is returned to the original state, so that the assembly process is completed.

If the assembly process is completed, the supporting portion 38 is placed higher than the end of the hinge shaft 32. Therefore, the hinge plate 42 fails to descend toward the end of the hinge shaft 32. As a result, the hinge plate 42 and the hinge shaft 32 are not disassembled.

In the aforementioned embodiment, while the detachment prevention portion 100 and the choke cover 35 are formed in an integral form, they may separately be formed.

The apparatus for assembling a door and a main body in a microwave oven according to the present invention has the following advantages.

First, since the door is assembled with the main body without using a separate detachment prevention cap, it is possible to reduce the manufacturing cost.

Second, since the assembly process is completed by pushing the door downwardly after the door is placed in the main body, the assembly process is simple.

Finally, since the cut-open portion of the choke cover is cut open as much as the thickness and length of the hinge plate, the cut-open portion can be minimized. Therefore, since the choke structure can be sealed to the maximum degree, it is possible to prevent a foreign substance from being entered into the choke structure.

It will be apparent to those skilled in the art that various modifications and variations can be made in the apparatus for assembling a door and a main body in a microwave oven according to the present invention without departing from the spirit or scope of the invention. Thus, it is intended that the present invention covers the modifications and variations of the invention provided they come within the scope of the appended claims and their equivalents.

What is claimed is:

1. An apparatus for mounting a door to a main body of a microwave oven, comprising:

a hinge plate mounted to the main body of a microwave oven and having at least one aperture;

a hinge shaft mounted on the door of the microwave oven, wherein a first end of the hinge shaft is exposed and configured to be inserted into the aperture in the hinge plate; and a detachment prevention device formed on the door and including at least a deformable blocking portion, wherein the detachment prevention device is configured such that deformation of the deformable blocking portion by the hinge plate is required to mount the door on the main body, and wherein deformation of the deformable blocking portion is also required to remove the door from the main body.

2. The apparatus of claim 1, wherein the detachment prevention device comprises a horizontal support surface.

3. The apparatus of claim 2, wherein the horizontal support surface is higher than the first end of the hinge shaft when the door is mounted on the main body.

4. The apparatus of claim 1, wherein the door further comprises:

a second hinge shaft mounted in the door, wherein a first end of the second hinge shaft is exposed; and a choke plate that prevents the escape of radiation from the main body.

5. The apparatus of claim 1, wherein the deformable blocking portion is adjacent to the hinge shaft.

6. The apparatus of claim 1, wherein a distance between a first section of the deformable blocking portion and the hinge shaft is less than a distance between a second section of the deformable blocking portion and the hinge shaft.

7. The apparatus of claim 1, wherein a distance between the hinge shaft and the deformable blocking portion changes at a substantially constant rate from a first section to a second section of the deformable blocking portion.

8. An apparatus for mounting a door to a main body of a microwave oven, comprising:

a hinge plate mounted to the main body of a microwave oven;

a hinge shaft mounted in the door of the microwave oven, wherein a first end of the hinge shaft is exposed; and a detachment prevention device, mounted in the door such that mounting the hinge shaft on the hinge plate requires deformation of the detachment prevention device, and such that the detachment prevention device prevents the hinge shaft from being removed from the hinge plate.

9. The apparatus of claim 8, wherein the detachment prevention device further comprises:

a horizontal support surface; and a deformable blocking portion.

10. The apparatus of claim 9, wherein the horizontal support surface has a feature that increases deformability of the deformable blocking portion.

11. The apparatus of claim 9, wherein the apparatus is configured such that the horizontal support surface is higher than the first end of the hinge shaft when the door is mounted on the main body.

12. The apparatus of claim 8, wherein a distance between a first section of the deformable blocking portion and the hinge shaft is less than a distance between a second section of the deformable blocking portion and the hinge shaft.

13. The apparatus of claim 8, wherein a distance between the hinge shaft and the deformable blocking portion varies at a substantially constant rate from a first section to a second section of the deformable blocking portion.

14. An apparatus for mounting a door to a main body of a microwave oven, comprising:

a hinge shaft mounted to one of the door and the main body of a microwave oven;

a hinge plate mounted to the other of the door and the main body of the microwave oven, wherein the hinge plate includes an aperture configured to receive the hinge shaft; and a detachment prevention device mounted to one of the door and the main body, wherein the detachment prevention device includes a deformable blocking portion configured such that mounting the door on the main body causes deformation of the deformable blocking portion, and such that deformation of the deformable blocking portion is required to remove the door from the main body.

15. The apparatus of claim 14, wherein the detachment prevention device comprises a horizontal support surface, and wherein the horizontal support surface is higher than a first end of the hinge shaft when the door is mounted on the main body.

16. The apparatus of claim 14, further comprising:

a second hinge shaft mounted in one of the door and the main body; and a choke plate that prevents escape of radiation from the main body.

17. The apparatus of claim 14, wherein the deformable blocking portion is adjacent to the hinge shaft.

18. The apparatus of claim 14, wherein a distance between a first section of the deformable blocking portion and the hinge shaft is less than a distance between a second section of the deformable blocking portion and the hinge shaft.

19. The apparatus of claim 14, wherein a distance between the hinge shaft and the deformable blocking portion changes at a substantially constant rate from a first section to a second section of the deformable blocking portion.

20. The apparatus of claim 14, wherein a feature of the deformable blocking portion increases the deformability of the blocking portion.

* * * * *